US010448460B2

(12) United States Patent
De Angelis

(10) Patent No.: US 10,448,460 B2
(45) Date of Patent: Oct. 15, 2019

(54) INDUCTION HEATING METHOD AND SYSTEM

(71) Applicant: ELECTROLUX APPLIANCES AKTIEBOLAG, Stockholm (SE)

(72) Inventor: Andrea De Angelis, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 26 days.

(21) Appl. No.: 15/764,955

(22) PCT Filed: Sep. 30, 2016

(86) PCT No.: PCT/EP2016/073393
§ 371 (c)(1),
(2) Date: Mar. 30, 2018

(87) PCT Pub. No.: WO2017/055529
PCT Pub. Date: Apr. 6, 2017

(65) Prior Publication Data

US 2018/0279420 A1 Sep. 27, 2018

(30) Foreign Application Priority Data

Oct. 2, 2015 (EP) ..... 15188157

(51) Int. Cl.
*H05B 6/04* (2006.01)
*H05B 6/06* (2006.01)
*H05B 6/12* (2006.01)

(52) U.S. Cl.
CPC ..... *H05B 6/06* (2013.01)

(58) Field of Classification Search
CPC . H05B 6/04; H05B 6/06; H05B 6/062; H05B 6/065; H05B 6/1254; H05B 6/1263; H05B 2213/05; H05B 2213/07
(Continued)

(56) References Cited

U.S. PATENT DOCUMENTS 3,887,781 A * 6/1975 Peters, Jr. ..... F24C 7/02 219/667
4,151,387 A * 4/1979 Peters, Jr. ..... F24C 7/02 219/626
2003/0155349 A1 8/2003 Matsuo et al.

FOREIGN PATENT DOCUMENTS

EP 0460279 A2 12/1991
GB 2085243 A 4/1982
WO 2013064332 A1 5/2013

OTHER PUBLICATIONS

International Search Report and Written Opinion issued in corresponding PCT application No. PCT/EP2016/073393 dated Jan. 3, 2017, 8 pages.

* cited by examiner

*Primary Examiner* — Hung D Nguyen
(74) *Attorney, Agent, or Firm* — Pearne & Gordon LLP

(57) ABSTRACT

An induction heating system includes an electrically conducting load and an inverter circuit having a switching section and a resonant section. The switching section includes switching devices adapted to generate an AC current from an AC input voltage having a plurality of half-waves. The resonant section includes an induction heating coil adapted to receive the AC current for generating a corresponding time-varying magnetic field in order to generate heat in the electrically conducting load by inductive coupling. The amount of heat generated in the load depends on the frequency of the AC current. A method of managing an induction heating system also is disclosed.

26 Claims, 10 Drawing Sheets

(58) Field of Classification Search
USPC ..... 219/620, 622, 624, 625, 626, 635,
219/660–668, 670–672, 675
See application file for complete search history.

INDUCTION HEATING METHOD AND SYSTEM

BACKGROUND OF THE INVENTION

Field of the Invention

The present invention generally relates to the field of induction heating. More specifically, the present invention relates to inverters for induction heating apparatuses.

Overview of the Related Art

Induction heating is a well-known method for heating an electrically conducting load by inducing eddy currents in the load through a time-varying magnetic field generated by an alternating current (hereinafter, simply AC current) flowing in an induction heating coil. The internal resistance of the load causes the induced eddy currents to generate heat in the load itself.

Induction heating is used in several applications, such as in the induction cooking field, wherein induction heating coils are located under a cooking hob surface for heating cooking pans made (or including portions) of electrically ferromagnetic material placed on the cooking hob surface, or in the ironing field, wherein induction heating coils are located under the main surface of an ironing board for heating an electrically conducting plate of a iron configured to transfer heat to clothes when the iron travels over the ironing board (similar considerations apply to a pressure iron system).

The amount of heat generated in the load depends on the electric power delivered to the load through the induction heating coil, which in turn depends on the frequency of the AC current flowing through the latter, the coupling between the load and the induction heating coil, and the time spent by the load at the induction heating coil.

Usually, the AC current used to generate the time-varying magnetic field is generated by means of an inverter circuit, such as a half bridge inverter, a full bridge inverter, or a quasi-resonant inverter, comprising a switching section including power switching elements, such as for example Insulated-Gate Bipolar Transistors (IGBT), and a resonant section comprising inductor(s) and capacitor(s), with the induction heating coil that is an inductor of the latter section. The inverter circuit is configured to receive an input alternating voltage (hereinafter, simply AC voltage), such as the mains voltage taken from the power grid, and to accordingly generate an AC current (flowing through the induction heating coil) oscillating at a frequency corresponding to actuation frequency of the power switching elements (i.e., the frequency with which they are switched between the on and the off state) and having an envelope following the input AC voltage, with the amplitude of the envelope that depends in turn on the actuation frequency itself (the lower the actuation frequency, the higher the amplitude thereof). The current flowing through the induction heating coil is sourced/drained by the power switching elements of the switching section.

Taking into consideration the half bridge architecture, in order to correctly operate the power switching elements in safe conditions, the actuation frequency should be kept lower than a maximum frequency depending on the type of power switching elements. For example, for standard IGBTs, such maximum frequency may correspond to 50-60 kHz.

As already mentioned above, the electric power delivered to the load through the induction heating coil depends on the frequency of the AC current flowing through the latter. With an inverter circuit of the type described above, the electric power provided to the load is at its maximum when the current flowing through the induction heating coil oscillates at the resonance frequency of the resonant section, i.e., when the actuation frequency is equal to the resonance frequency.

As it is well known to those skilled in the art, if the power switching elements are driven for a certain time at actuation frequencies lower than resonance frequency, the power switching elements may be irreparably damaged because of heat dissipation, and control instability due to loss of soft switching conditions.

Therefore, to ensure safe actuation of the inverter circuit, the actuation frequency should be set to be:

- lower than the power switching element maximum frequency;
- higher than the resonance frequency.

While the first value is fixed and known in advance (depending on the type of power switching elements), the resonance frequency strongly depends on the coupling between the induction heating coil and the load, i.e., it depends from a series of unpredictable features such as the type of load, the distance between load and induction heating coil, the geometry of the load and of the induction heating coil.

Devices which exploit induction heating should be provided with a control unit specifically designed to avoid that the actuation frequency falls outside the safe range defined above. When a user of a device of this kind is requesting a specific electric power (e.g., corresponding to a specific temperature to be reached by a cooking pan or by a clothes iron), such control unit has to check whether the desired electric power requested by the user corresponds to an actuation frequency which falls within the safe range. In the affirmative case, the control unit is configured to dispense the requested electric power. In the negative case, the exact request of the user cannot be satisfied, and the control unit may be configured to set the electric power to a safe level different to the requested one.

In order to ensure safe actuation of the inverter circuit, a further constraint has to be fulfilled, relating to the maximum current that the power switching elements are able to sustain for a certain time without damage. For example, standard IGBTs, commonly used in household appliances for induction applications, are designed to sustain current values not higher than 50-60 A.

For this reason, the inverter circuit is usually provided with a clamping circuit configured to clamp the current flowing through the induction heating coil before it reaches the maximum current that can be sustained by the power switching elements. Moreover, the inverter circuit is further provided with a software protection configured to clamp the actuation frequency if said maximum current is approached, before the activation of the clamping circuit for the current.

Since the envelope of the AC current flowing through the induction heating coil has an amplitude that depends on the actuation frequency (the lower the actuation frequency, the higher the amplitude thereof), it is not possible to known a priori whether a selected actuation frequency corresponds to a current flowing through the induction heating coil that is lower than the maximum current or not.

EP1734789 discloses a method involving providing an alternating supply voltage and a frequency converter with an adjustable switching unit. The operating frequency of the switching unit and/or the frequency converter is increased from a frequency base in the course of half cycle of the voltage. The frequency is then decreased to the base, so that the frequency amounts to the base, at the zero crossing of the supply voltage.

SUMMARY OF THE INVENTION

The Applicant has observed that since the resonance frequency is not known in advance, and may dynamically vary during the use of an induction heating system (for example, because the distance or the relative position between a device to be inductively heated and the induction heating coil is continuously varied), such control unit should be provided with the capability of determining which is the resonance frequency and/or checking whether a certain actuation frequency range is a safe range (in the sense that the resonance frequency limit is respected). And/or, the control unit of the induction heating system should be provided with the capability of determining a minimum actuation frequency (hereinafter referred to as current limit frequency) for which the current flowing through the induction heating coil is lower than the maximum current that the power switching elements are able to sustain for a certain time without damage, and/or checking whether a certain actuation frequency range is a safe range (in the sense that the limit given by the current limit frequency is respected).

The aim of the present invention is therefore to provide a method for managing an induction heating system and a corresponding induction heating system which allows to assess at least one among the inverter resonance frequency and the current limit frequency and/or checking whether a certain actuation frequency range is a safe range in a fast way.

An aspect of the present invention proposes a method for managing an induction heating system. The induction heating system comprises an electrically conducting load and an inverter circuit comprising a switching section and a resonant section. The switching section comprises switching devices adapted to generate an AC current from an AC input voltage comprising a plurality of half-waves. The resonant section comprises an induction heating coil adapted to receive the AC current for generating a corresponding time-varying magnetic field in order to generate heat in the electrically conducting load by inductive coupling. The AC current oscillates at an actuation frequency of the switching devices and has an envelope comprising a plurality of half-waves corresponding to the half-waves of the AC input voltage. The amount of heat generated in the load depends on the frequency of the AC current. The method comprises varying, within a same half-wave of the envelope, the actuation frequency according to a plurality of actuation frequency values; determining a safe actuation frequency range; setting the actuation frequency based on said determined safe actuation frequency range. Said determining a safe actuation frequency range comprises calculating at least one between:

- the closeness of each actuation frequency value to a resonance frequency of the resonant section,
- the closeness of each actuation frequency value to a current limit frequency corresponding to the maximum sustainable current by the switching devices.

According to an embodiment of the present invention, said step of calculating the closeness of each actuation frequency value to a resonance frequency of the resonant section comprises measuring the distance between the zero crossing time of the voltage across the induction heating coil and the zero crossing time of the AC current.

According to an embodiment of the present invention, said step of calculating the closeness of each actuation frequency value to a resonance frequency of the resonant section comprises calculating a power factor corresponding to the induction heating coil.

According to an embodiment of the present invention, said step of varying, within a same half-wave of the envelope, the actuation frequency comprises setting step by step the actuation frequency according to a sequence of actuation frequency values, each actuation frequency value of the sequence being set for a corresponding time interval corresponding to a fraction of the duration of the half-wave of the envelope.

According to an embodiment of the present invention, said step of calculating the closeness of each actuation frequency value to a current limit frequency corresponding to the maximum sustainable current by the switching devices comprises:

- for each actuation frequency value of the sequence, calculating a current positive peak corresponding to the highest positive value assumed by the AC current during the corresponding time interval, and/or calculating a current negative peak corresponding to the lowest positive value assumed by the AC current during the corresponding time interval;
- calculating the closeness of each actuation frequency value to said current limit frequency based on said current positive peaks and/or current negative peaks.

According to an embodiment of the present invention, the method further comprises normalizing each current positive peak and/or current negative peak according to the position of the corresponding time interval with respect to said half-wave. Said calculating the closeness of each actuation frequency value to said current limit frequency based on said current positive peaks and/or current negative peaks further comprises calculating the closeness of each actuation frequency value to said current limit frequency based on said normalized current positive peaks and/or said normalized current negative peaks.

According to an embodiment of the present invention, said step of varying, within a same half-wave of the envelope, the actuation frequency comprises spanning a corresponding actuation frequency range. The method further includes, conditioned to the assessment that the values of said spanned actuation frequency range are higher than the resonance frequency and the current limit frequency, selecting said safe actuation frequency range as said spanned actuation frequency range.

According to an embodiment of the present invention, the method further comprises, conditioned to the assessment that at least one among the resonance frequency and the current limit frequency is higher than at least one value of said spanned actuation frequency, selecting said safe actuation frequency range from a subrange of said spanned actuation frequency. The values of said selected subrange are all higher than said resonance frequency and said current limit frequency.

According to an embodiment of the present invention, said sequence of actuation frequency values comprises a first sequence portion starting from a first actuation frequency value and then proceeding with lower actuation frequency values at every time interval corresponding to a fraction of the duration of the half-wave of the envelope.

Preferably, said first sequence portion provides for proceeding with progressively lower actuation frequency values at every time interval corresponding to a fraction of the duration of the half-wave of the envelope.

According to an embodiment of the present invention, said sequence of actuation frequency values comprises a second sequence portion starting from the last actuation frequency value of the first sequence portion and then proceeding with higher actuation frequency values at every time interval corresponding to a fraction of the duration of the half-wave of the envelope.

Preferably, said second sequence portion provides for proceeding with progressively higher actuation frequency values at every time interval corresponding to a fraction of the duration of the half-wave of the envelope.

According to an embodiment of the present invention, said sequence of actuation frequency values comprises a first sequence portion starting from a first actuation frequency value and then proceeding with higher actuation frequency values at every time interval corresponding to a fraction of the duration of the half-wave of the envelope.

Preferably, said first sequence portion provides for proceeding with progressively higher actuation frequency values at every time interval corresponding to a fraction of the duration of the half-wave of the envelope.

According to an embodiment of the present invention, said sequence of actuation frequency values comprises a second sequence portion starting from the last actuation frequency value of the first sequence portion and then proceeding with lower actuation frequency values at every time interval corresponding to a fraction of the duration of the half-wave of the envelope.

Preferably, said second sequence portion provides for proceeding with progressively lower actuation frequency values at every time interval corresponding to a fraction of the duration of the half-wave of the envelope.

According to an embodiment of the present invention, said step of varying, within a same half-wave of the envelope, the actuation frequency comprises setting each new actuation frequency value of the sequence except the first one based on the distance of the previous actuation frequency value in the sequence with respect to the actual resonance frequency.

According to an embodiment of the present invention, the method further comprises, as soon as the closeness of a actuation frequency value to a resonance frequency of the resonant section is ascertained to be lower than a predefined threshold, limiting the actuation frequency to a value corresponding to said actuation frequency value.

According to an embodiment of the present invention, the method further comprises calculating an estimation of at least one among the resonance frequency and the current limit frequency.

According to an embodiment of the present invention, the method further comprises calculating an estimation of the resonance frequency by taking into account the actuation frequency value which is the closest one, among the plurality of actuation frequency values, to the resonance frequency itself.

According to an embodiment of the present invention, said method further comprises calculating an estimation of the current limit frequency by taking into account the actuation frequency value which is the closest one, among the plurality of actuation frequency values, to the current limit frequency itself.

According to an embodiment of the present invention, the induction heating system comprises a group of at least two induction heating coils. The method comprises, for each induction heating coil of the group, calculating an estimation of the resonance frequency and an estimation of the current limit frequency corresponding to such induction heating coil; setting a global resonance frequency based on the calculated estimations of the resonance frequency corresponding to the induction heating coils of the group; setting a global current limit frequency based on the calculated estimations of the current limit frequency corresponding to the induction heating coils of the group; determining the safe actuation frequency range according to said global resonance frequency and to said global current limit frequency.

According to an embodiment of the present invention, said setting the global resonance frequency comprises setting the global resonance frequency to the highest one among the calculated estimations of the resonance frequency corresponding to the induction heating coils of the group, and said setting the global current limit frequency comprises setting the global current limit frequency to the highest one among the calculated estimations of the current limit frequency corresponding to the induction heating coils of the group.

According to an embodiment of the present invention, said calculating an estimation of the resonance frequency and an estimation of the current limit frequency for each induction heating coil of the group is concurrently carried out for all the induction coils of the group in a same half-wave of the envelope.

According to an embodiment of the present invention, said calculating an estimation of the resonance frequency and an estimation of the current limit frequency for each induction heating coil of the group is sequentially carried out for all the induction coils of the group in sequential half-waves of the envelope.

According to an embodiment of the present invention, said calculating an estimation of the resonance frequency and an estimation of the current limit frequency for each induction heating coil of the group comprises varying the actuation frequency for each induction heating coil of the group according to a same sequence of actuation frequency values.

According to an embodiment of the present invention, said calculating an estimation of the resonance frequency and an estimation of the current limit frequency for each induction heating coil of the group comprises varying the actuation frequency for each induction heating coil of the group according to a respective sequence of actuation frequency values.

Another aspect of the present invention provides for an induction heating system for heating an electrically conducting load. The induction heating system comprises an inverter circuit comprising a switching section and a resonant section. The switching section comprises switching devices adapted to generate an AC current from an AC input voltage comprising a plurality of half-waves. The resonant section comprises an induction heating coil adapted to receive the AC current for generating a corresponding time-varying magnetic field in order to generate heat in the electrically conducting load by inductive coupling. The AC current oscillates at an actuation frequency of the switching devices and has an envelope comprising a plurality of half-waves corresponding to the half-waves of the AC input voltage. The amount of heat generated in the load depends on the frequency of the AC current. The induction heating system further comprises a control unit configured to: vary, within a same half-wave of the envelope, the actuation frequency according to a plurality of actuation frequency values; determine a safe actuation frequency range; set the actuation frequency based on said determined safe actuation frequency range. The control unit is further configured to determine the safe actuation frequency range by calculating at least one between:

the closeness of each actuation frequency value to a resonance frequency of the resonant section, the closeness of each actuation frequency value to a current limit frequency corresponding to the maximum sustainable current by the switching devices.

According to an embodiment of the present invention, said inverter circuit is a selected one among a half-bridge inverter circuit, a full-bridge inverter circuit, and a quasi-resonant inverter circuit.

According to an embodiment of the present invention, said electrically conducting load is a plate of a clothes iron and said induction heating coil is mounted on an ironing board.

According to an embodiment of the present invention, said electrically conducting load is a portion of a cooking pan, and said induction heating coil is mounted in a cooking hob.

According to an embodiment of the present invention, said electrically conducting load is a tank of a water heater, and said induction heating coil is mounted in a water heater.

BRIEF DESCRIPTION OF THE DRAWINGS

These, and others, features and advantages of the solution according to the present invention will be better understood by reading the following detailed description of some embodiments thereof, provided merely by way of exemplary and non-limitative examples, to be read in conjunction with the attached drawings, wherein.

DETAILED DESCRIPTION OF THE INVENTION

Figure 1A:
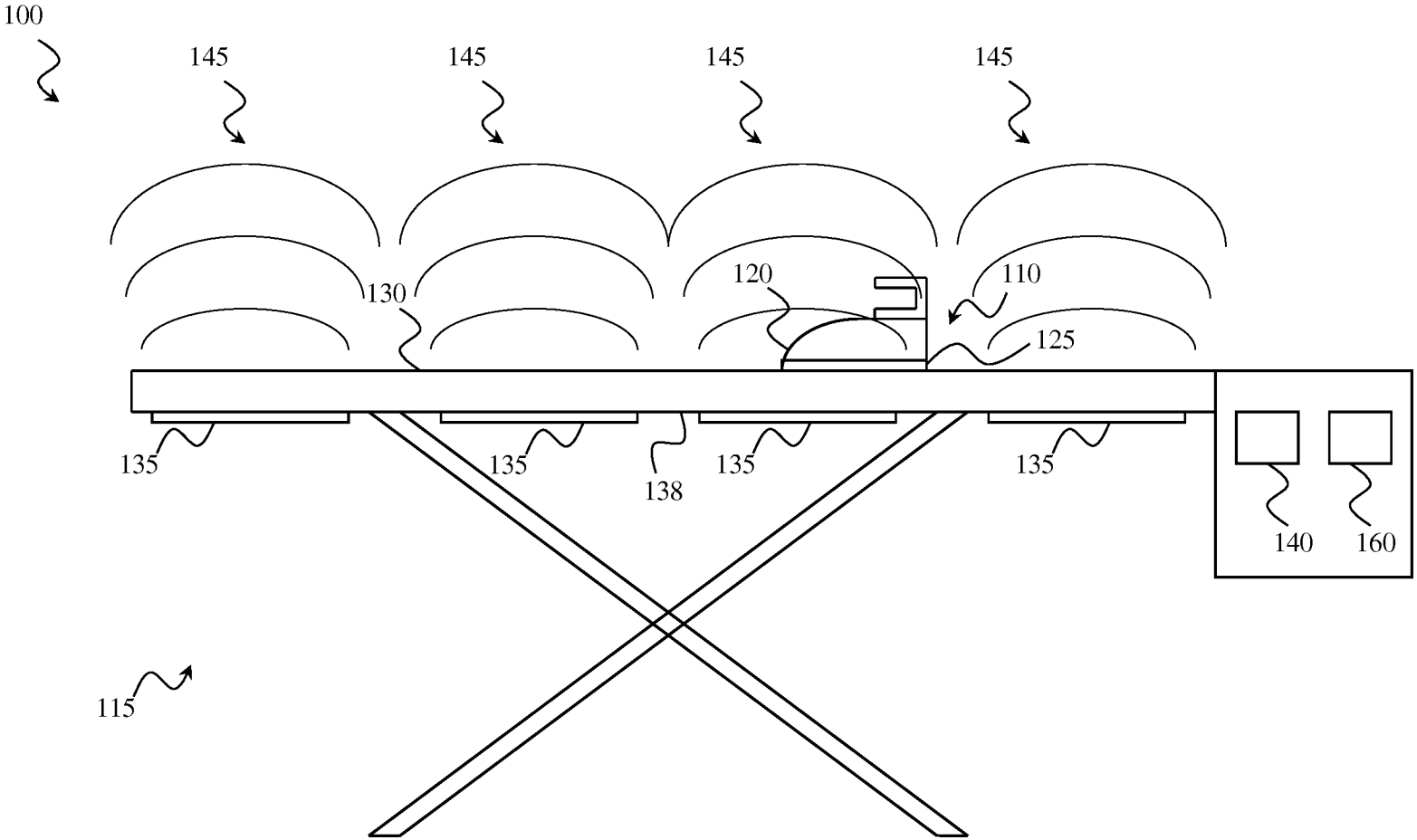
FIG. 1A illustrates an exemplary induction ironing system.

With reference to the drawings, FIG. 1A illustrates an exemplary induction ironing system 100 wherein the concepts of the solution according to embodiments of the invention can be applied.

The induction ironing system 100 comprises a clothes iron 110 and an ironing board 115.

The clothes iron 110 comprises a main body 120 made of an electrically insulating material, and a plate 125 made of an electrically conducting material, such as chrome nickel steel, for example secured to the bottom portion of the main body 120.

The clothes iron 110 is configured to travel on a main surface 130 of the ironing board 115. The main surface 130 is made of a non-conductive material. A piece of textile material to be ironed is supported on the main surface 130 in a conventional manner, not shown. Induction coils 135 are mounted, e.g., in a longitudinal, spaced arrangement, on a bottom surface 138 of the ironing board 115 opposed to the main surface 130.

In a preferred embodiment each induction coil 135 is operable to be fed with AC current provided by a respective inverter circuit 140.

When an induction coil 135 is crossed by an AC current of a suitable frequency, a time-varying magnetic field 145 is generated, which is capable of inducing eddy currents in the plate 125 of the clothes iron 110 when the latter intersects the magnetic field 145 when traveling on the main surface 130. The induced eddy currents cause the plate 125 to rapidly heat up to a desired working temperature. The thermal energy lost by contact with the (non-illustrated) textile material to be ironed is replaced continuously by the current provided by the inverter circuit 140.

The ironing board 115 is further provided with a control unit 160 configured to control the inverter circuits 140 in order to regulate the frequency of the AC current flowing in the induction coils 135 in such a way to regulate the electric power transferred from the inverter circuits 140 to the plate 125, and therefore, the temperature of the latter.

Figure 1B:
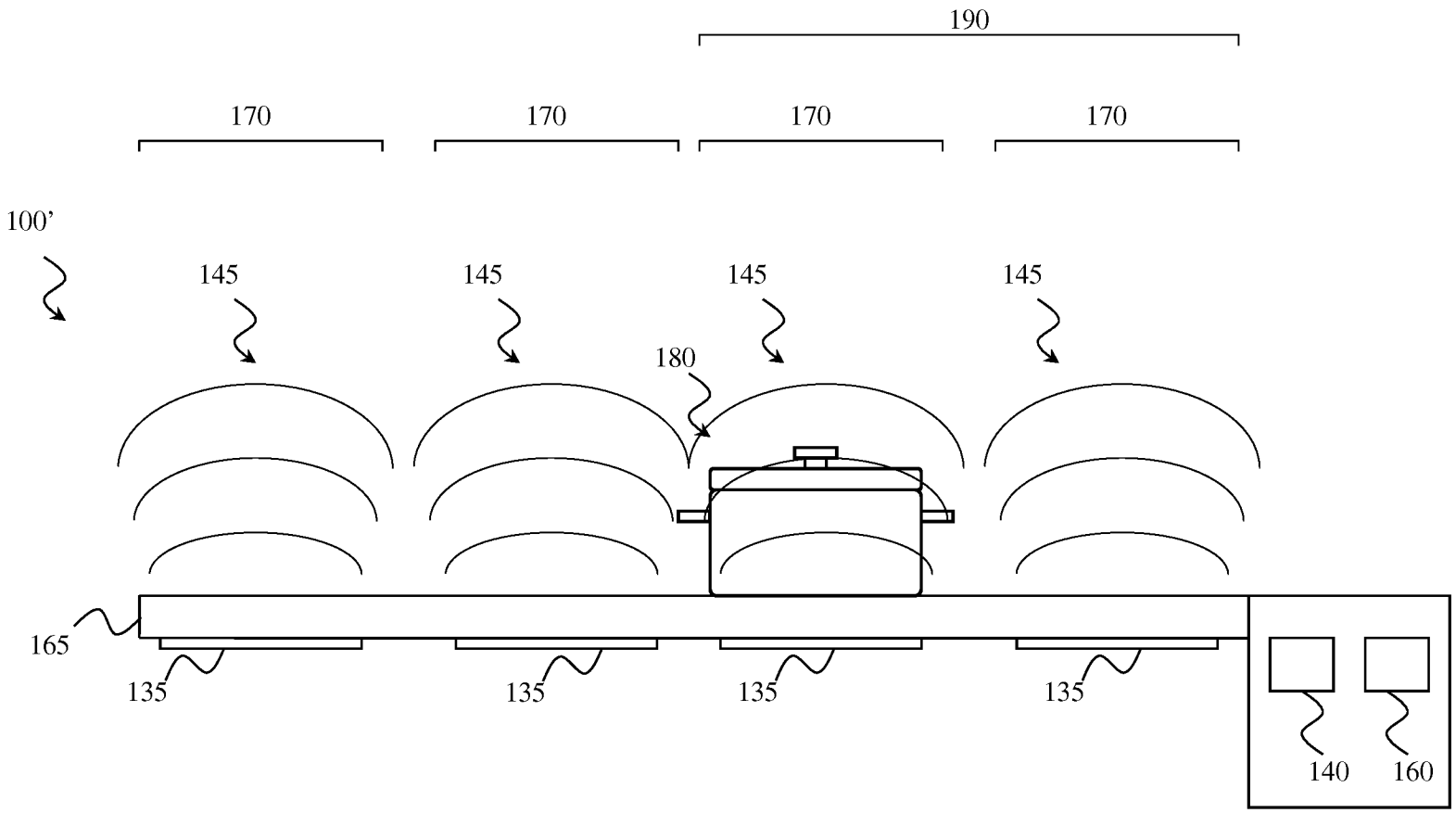
FIG. 1B illustrates an exemplary cooking hob system.

As already mentioned in the introduction of the present document, induction heating by means of induction coils may be used in other applications, such as for example in the induction cooking field. For this reason, reference is now made to FIG. 1B, which illustrates an exemplary induction cooking system 100' wherein the concepts of the solution according to embodiments of the invention can be applied.

Elements of the induction cooking system 100' which are identical or similar to corresponding elements of the induction ironing system 100 will be identified with same references.

The induction cooking system 100' comprises a (e.g., glass-ceramic) cooking surface 165. A number of induction coils 135 are placed underneath the cooking surface 165.

The induction coils 135 are selectively operable for defining one or more cooking zones 170. In a preferred embodiment each induction coil 135 is selectively operable to be fed with AC current provided by a respective inverter circuit 140.

During operation, after a cooking pan 180 made (or including portions) of ferromagnetic material (such as stainless steel or iron) and containing food to be cooked is rested on the cooking surface 165 at a cooking zone 170, the inverter circuit(s) 140 causes an AC current to flow through the (one or more) respective induction coil(s) 135. This current flow generates a time-varying magnetic field 145, which is capable of inducing eddy currents in the cooking pan 180 (or in the portions thereof made of ferromagnetic material). The induced eddy currents cause the cooking pan 180 (or the portions thereof made of ferromagnetic material) to rapidly heat up to a desired working temperature. The thermal energy lost by contact with the (non-illustrated) food contained in the cooking pan 180 is replaced continuously by the current provided by the inverter circuit 140.

As in the case of the induction ironing system 100, the induction cooking system 100' comprises a control unit 160 configured to control the inverter circuits 140 in order to regulate the frequency of the AC current flowing in the induction coils 135 in such a way to regulate the electric power transferred from the generic inverter circuit 140 to the corresponding cooking pan 180, and therefore, the temperature of the latter.

Figure 2A:
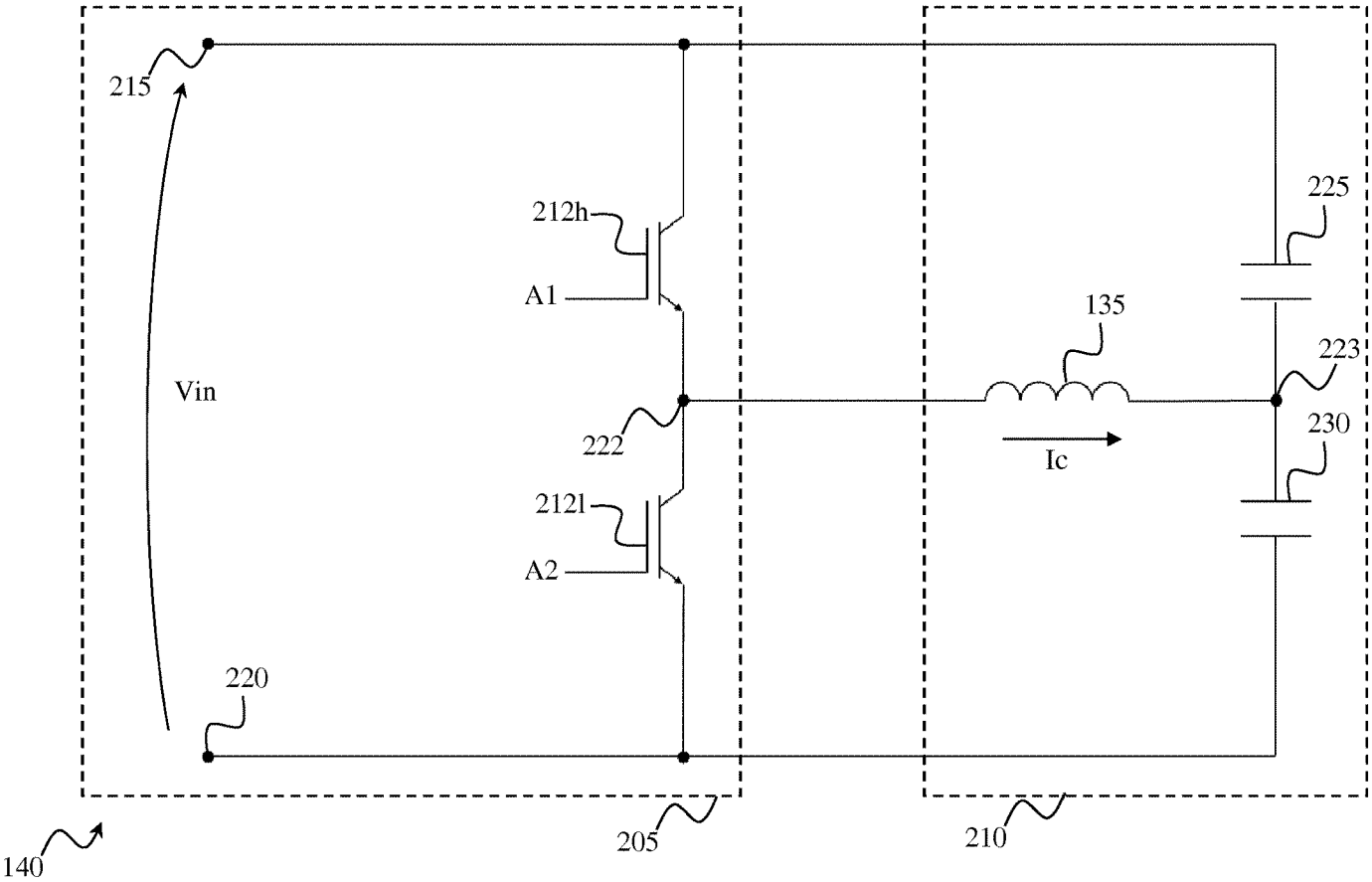
FIG. 2A is an exemplary circuit diagram of an inverter circuit for feeding AC current to an induction coil of the ironing system of FIG. 1A or of the cooking hob system of FIG. 1B.

FIG. 2A is an exemplary circuit diagram of an inverter circuit 140 for feeding AC current to an induction coil 135 of the induction ironing system 100 or of the induction cooking system 100' wherein the concepts of the solution according to embodiments of the invention can be applied. In the example at issue, the inverter circuit 140 is a half-bridge inverter circuit, however similar considerations apply in case different types of inverter circuits arrangements are used, such as a full-bridge inverter circuit or a quasi-resonant inverter circuit.

The inverter circuit 140 comprises two main sections: a switching section 205 and a resonant section 210.

The switching section 205 comprises two insulated-gate bipolar transistors (IGBT) 212*h*, 212*l* connected in series between the line terminal 215 and the neutral terminal 220 of the power grid. An input AC voltage Vin (the mains voltage) develops between the line terminal 215 and the neutral terminal 220, oscillating at a mains frequency Fm, such as 50 Hz. The IGBT 212*h* has a collector terminal connected to the line terminal 215, a gate terminal for receiving a control signal A1, and an emitter terminal connected to the collector terminal of the IGBT 212*l*, defining a circuit node 222 therewith. The IGBT 212*l* has an emitter terminal connected to neutral terminal 220 and a gate terminal for receiving a control signal A2. The control signals A1 and A2 are digital periodic signals oscillating at a same frequency, hereinafter referred to as actuation frequency Fa, between a high value and a low value, with a mutual phase difference of 180°, so that when the IGBT 212*h* is turned on, the IGBT 212*l* is turned off, and vice-versa. Similar considerations apply if different types of electronic switching devices are employed in place of IGBTs.

The resonant section 210 comprises the induction coil 135 and two resonance capacitors 225, 230. The resonance capacitor 225 has a first terminal connected to the collector terminal of the IGBT 212*h* and a second terminal connected to a first terminal of the resonance capacitor 230, defining a circuit node 223 therewith. The resonance capacitor 230 has a second terminal connected to the emitter terminal of the IGBT 212*l*.

The induction heating coil 135 is connected between circuit nodes 222 and 223.

Figure 3:
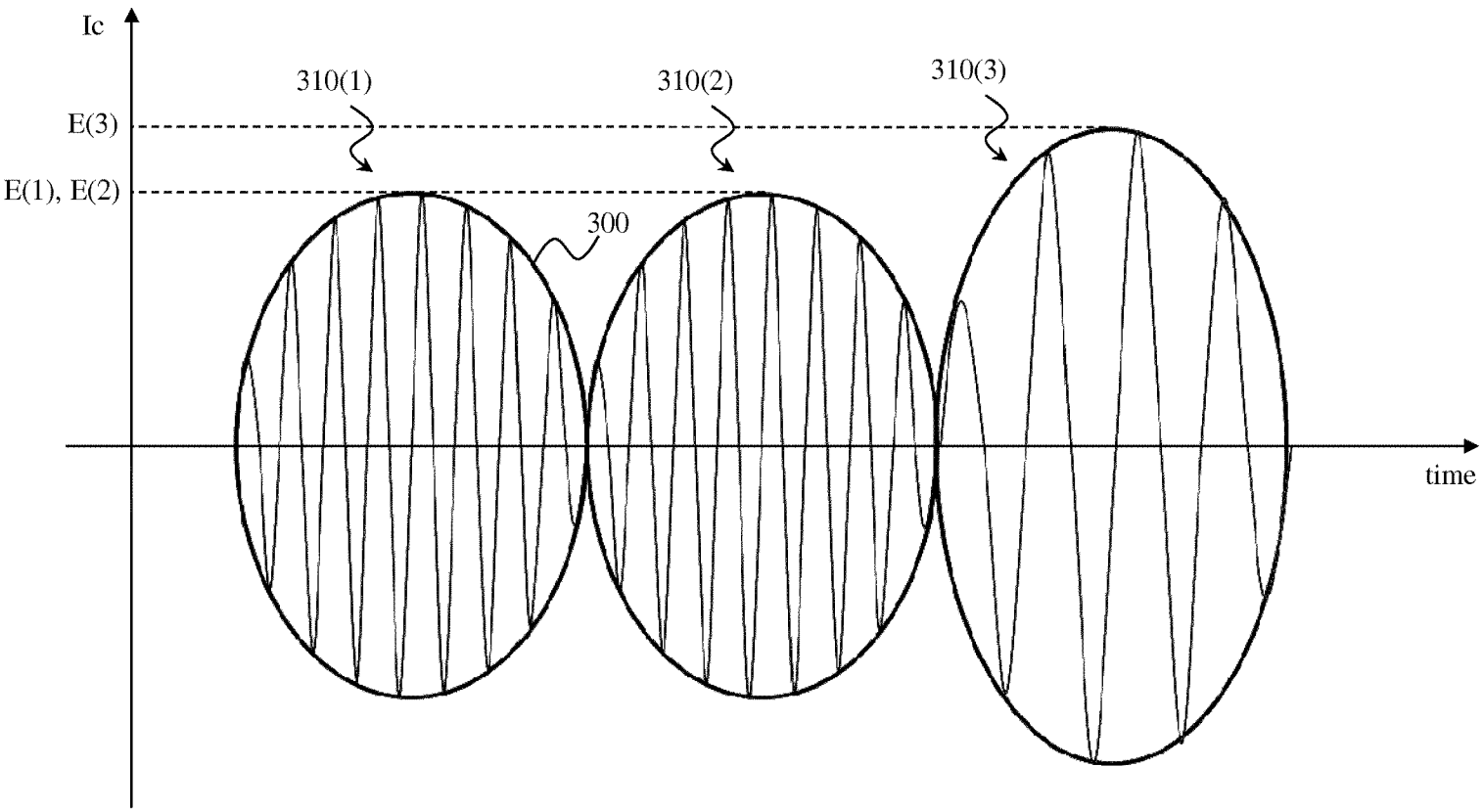
FIG. 3 illustrates a time trend of the induction heating coil current of the inverter circuit of FIG. 2A, as well as the envelope of such current.

During operation, the current Ic flowing through the induction heating coil 135 is alternatively sourced by the IGBT 212*h* (when the IGBT 212*h* is on and the IGBT 212*l* is off) and drained by the IGBT 212*l* (when the IGBT 212*h* is off and the IGBT 212*l* is on). As illustrated in FIG. 3, the induction heating coil current Ic oscillates at the actuation frequency Fa, and has an envelope 300 that follows the input AC voltage Vin, i.e., it comprises a plurality of half waves 310(*i*), each one corresponding to a respective half wave of the input AC voltage Vin and therefore having a duration equal to the semiperiod of the input AC voltage Vin (i.e., 1/(2*Fm)). At the end of each half wave of the envelope 300, the induction heating coil current Ic returns to zero (if an actuation with a suitable load is performed). The envelope 300 has an amplitude that depends on the actuation frequency Fa: the lower the actuation frequency Fa, the higher the amplitude. The portion of the envelope 300 of the induction heating coil current Ic illustrated in FIG. 3 has three half waves 310(1), 310(2), 310(3), each one having a corresponding amplitude E(1), E(2), E(3). The first two half waves 310(1), 310(2) of the envelope 300 correspond to an actuation frequency Fa higher than the one corresponding to the third half wave 310(3). Therefore, the amplitude E(3) of the third half wave 310(3) is higher than the one of the first two half waves 310(1), 310(2).

Figure 2B:
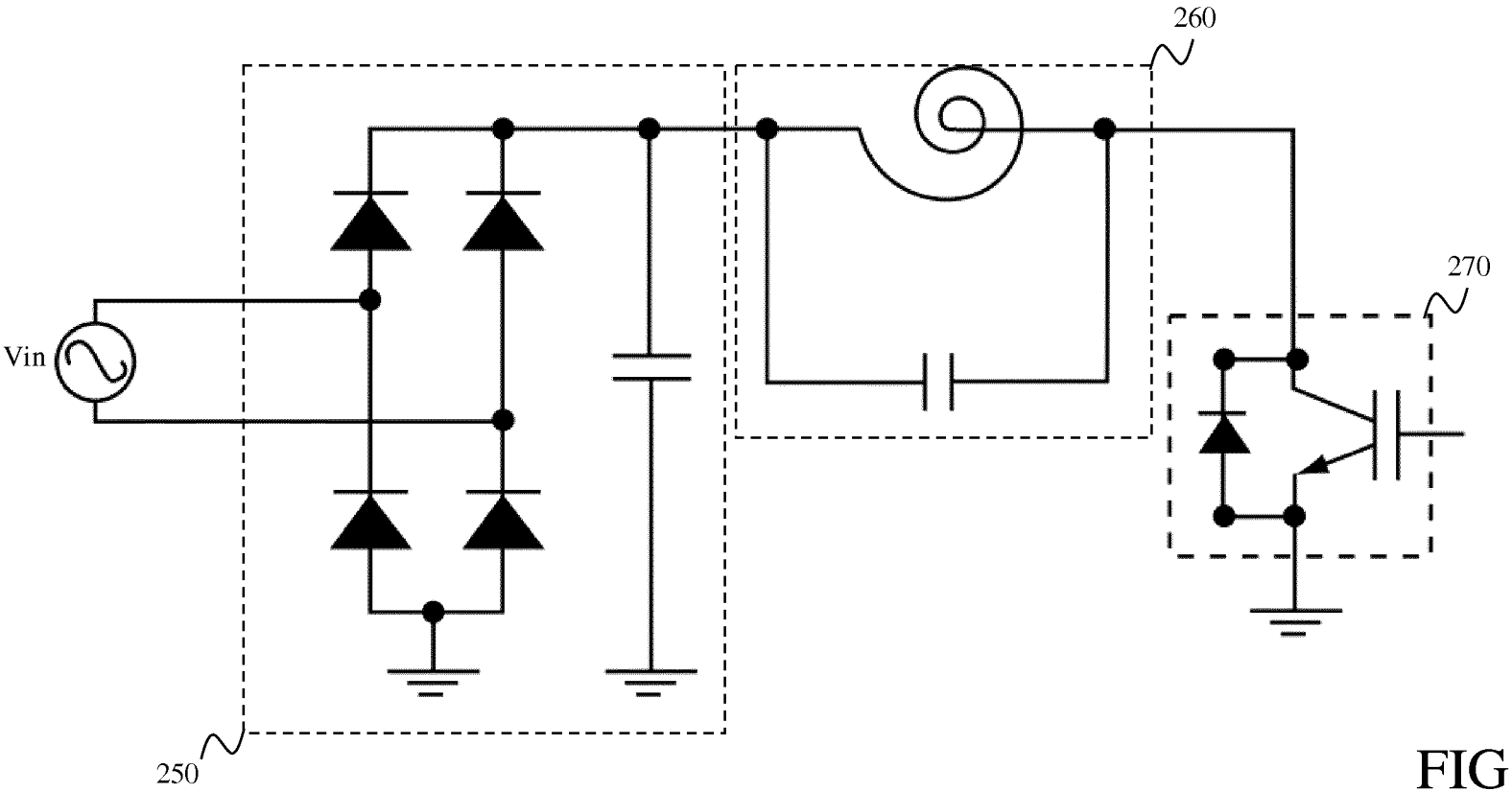
FIG. 2B is an exemplary circuit of another inverter circuit for feeding AC current to an induction coil of the ironing system of FIG. 1A or of the cooking hob system of FIG. 1B.

As mentioned above, the concepts of the present invention can be applied as well to an inverter circuit 140 of the quasi-resonant type, such as the one illustrated in FIG. 2B, comprising a rectifier 250 (for example, a bridge rectifier) adapted to rectify the input AC voltage Vin, a quasi-resonant circuit 260 (for example comprising an inductor in parallel to a capacitor) corresponding to the resonant section 210 of the half-bridge inverter circuit 140 of FIG. 2A, and a switching circuit 270 (for example comprising a single transistor) corresponding to the switching section 205 of the half-bridge inverter circuit 140 of FIG. 2A.

As already mentioned above, to ensure safe actuation of the inverter circuits 140 without causing irreversible damage to the IGBTs 212*h*, 212*l*, the actuation frequency Fa should be set higher than the resonance frequency Fr.

Moreover, in order to be sure that the induction heating coil current Ic is lower than the maximum current the IGBTs 212*h*, 212*l* are able to sustain (for a relatively prolonged time), the actuation frequency Fa should be set higher than the current limit frequency Fc.

The above conditions (Fa>Fr, Fa>Fc) define limits for safe actuation frequency ranges.

Therefore, according to an embodiment of the present invention, when the temperature setting provided by the user of the ironing system 100 or of the cooking system 100' involves the request of a specific amount of electric power to be delivered, the control unit 160 is configured to check whether such electric power request corresponds to an actuation frequency Fa which falls within a safe frequency range.

In order to be capable of performing this task, the control unit 160 is further configured to dynamically (i.e., during the operation of the ironing system 100 or of the cooking system 100') determine, or at least assess, the resonance frequency Fr as well as the current limit frequency Fc, or checking whether a certain actuation frequency range is a safe range (in the sense that the above-mentioned frequency limits are respected). In this way, account is taken of the fact that both the resonance frequency Fr and the current limit frequency Fc strongly depend on the actual coupling between the plate 125 of the clothes iron 110 and the induction heating coil 135 (ironing system 100 case), or on the actual coupling between the cooking pan 180 and the induction heating coil 135 (cooking system 100' case).

Since said coupling may change in a very fast way (e.g., every 0.1-0.5 sec), the control unit 160 should be capable of e.g. determining (or at least assessing) the resonance frequency Fr and the current limit frequency Fc (or to check whether a certain actuation frequency range is a safe range (in the sense that the above-mentioned frequency limits are respected) within the strict time requirements given by the fast coupling changes.

A possible method for identifying the resonance frequency Fr may provide for carrying out a preliminary inspection phase in which the actuation frequency Fa is varied step by step according to a sequence of predetermined actuation frequency values, with each actuation frequency value of the sequence that is maintained for a respective half wave (or also more than one consecutive half waves) of the envelope of the AC voltage Vin. Using known resonance identification procedures, such as by measuring the distance between the zero crossing time of the induction heating coil current Ic and the zero crossing time of the induction heating coil voltage, a check is made during each half wave of the envelope of the AC voltage Vin to evaluate the closeness of the corresponding actuation frequency value to the resonance frequency Fr. Moreover, for each actuation frequency value, a corresponding power measurement is carried out. A power characteristic curve is then construed from such measurements, expressing how the power deliverable to the load varies in function of the actuation frequency.

Another possible method provides for setting the actuation frequency step by step, with each actuation frequency value of the sequence that is maintained for a respective half wave of the envelope of the AC voltage Vin, starting from a safe (e.g., high) actuation frequency value, and continuing until the desired power value is reached or until a frequency close to the resonance frequency Fr is reached (if the latter actuation frequency occurs prior the one corresponding to desired power value).

Regarding instead the current limit frequency Fc, a possible method may provide for varying the actuation frequency step by step according to a sequence of (decreasing) predetermined actuation frequency values, with each actuation frequency value of the sequence that is maintained for a respective half wave of the envelope of the AC voltage Vin, until the limit is reached. Then, the value taken by the actuation frequency during the half wave of the envelope of the AC voltage Vin in which the maximum current is approached is identified as the current limit frequency Fc, i.e. the minimum actuation frequency value for which the AC current Ic flowing through the induction heating coil is lower than the maximum current that can be sustained (for a relatively prolonged) by the power switching elements. Moreover, for each actuation frequency value, the maximum peak current value is advantageously measured within the corresponding half wave of the envelope of the AC voltage Vin, so as to be able to construct an induction heating coil current characteristic curve, expressing how the maximum peak current varies in function of the actuation frequency.

Applicant has observed that such methods described above are time consuming and require to perform operation every half wave of the envelope of the AC voltage Vin. Thus, they are capable of obtaining results only after relatively long time periods, such as for example from 0.1 sec up to 2 sec (with an input AC voltage Vin oscillating at 50 Hz, it means 10 to 200 halfwaves).

Applicant has observed that in several applications, such as in induction ironing, the coupling between the load (i.e., the plate 125) and the induction heating coil 135 may change in a very fast way (e.g., every 0.1-0.5 sec), which is not compatible with the time required by the inspection methods mentioned above. Indeed, since ironing process is a process which is essentially dynamic and user dependent, the load-coil coupling may change every time the position of the clothes iron 110 changes with respect to the position of the induction heating coil 135. Therefore, the inspection methods mentioned above are not efficient from the power delivery point of view.

According to an embodiment of the present invention, the safe actuation frequency range having regard to the resonance frequency Fr and having regard to the current limit frequency Fc is assessed through two respective assessing procedures. Said two assessing procedures may be carried out by the control unit 160 either concurrently or individually.

Safe Actuation Frequency Range Assessment Having Regard to the Resonance Frequency According to an embodiment of the present invention, the procedure for assessing the safe actuation frequency range having regard to the resonance frequency Fr is carried out by the control unit 160 by varying step by step the actuation frequency Fa of the control signals A1, A2 according to a sequence of actuation frequency values TFa(j) within a same half wave 310(*i*) of the envelope 300 of the current Ic, and calculating at each step the closeness of the corresponding actuation frequency value TFa(j) to the resonance frequency Fr using a resonance identification procedure.

The procedure for assessing the safe actuation frequency range having regard to the resonance frequency Fr according to an embodiment of the present invention is initiated by the control unit 160 by setting the actuation frequency Fa to the first actuation frequency value TFa(1) of the sequence as soon as a halfwave 310(*i*) of the envelope 300 of the induction heating coil current Ic is initiated. This can be detected by assessing the zero crossing time of the input AC voltage Vin (which identifies the beginning of a halfwave 310(*i*) of the envelope 300) through a proper zero voltage crossing circuit (not illustrated). The following actuation frequency values TFa(j) of the sequence are then set step by step by the control unit 160 within the same halfwave 310(*i*) of the envelope 300. Therefore, for an input AC voltage Vin oscillating at a mains frequency Fm of 50 Hz, the procedure for assessing the safe actuation frequency range having regard to the resonance frequency Fr lasts at most 10 ms. As soon as the actuation frequency Fa is set to a new actuation frequency value TFa(j), the control unit 160 checks the closeness of such actuation frequency value TFa(j) to the resonance frequency Fr using known methods, such as by measuring the distance between the zero crossing time of the induction heating coil voltage and the zero crossing time of the induction heating coil current Ic, or by checking the sign of the induction heating coil current Ic at the zero crossing time of the induction heating coil voltage. In this way, the control unit 160 is able to determine which one among the plurality of actuation frequency values TFa(j) is the closest to the resonance frequency Fr.

According to an embodiment of the present invention, the sequence of actuation frequency values TFa(j) is a predefined sequence, for example stored in the control unit itself 160 in form of tables or defined by means of a mathematic relationship (such as for example "decreasing by an amount X multiplied by a factor related to the distance from the resonance frequency Fr").

According to an embodiment of the present invention, the control unit 160 is configured to assess whether the frequency range spanned by the sequence of actuation frequency values TFa(j) is a safe actuation frequency range for the operation of the system by taking into consideration the closeness of each actuation frequency value TFa(j) of the sequence to the resonance frequency Fr (e.g., by calculating for each actuation frequency value TFa(j) the distance between the zero crossing time of the induction heating coil voltage and the zero crossing time of the induction heating coil current Ic).

If the frequency range spanned by the sequence of actuation frequency values TFa(j) has been assessed not to include the resonance frequency Fr because both the higher and lower boundaries of the spanned frequency range have been assessed to be higher than the resonance frequency Fr, such frequency range can be considered as a safe actuation frequency range (at least from the resonance frequency Fr point of view). This means that the control unit 160 is aware of the possibility to set (for power delivery) the actuation frequency Fa to any value comprised in said actuation frequency range without incurring in the risk of reaching and going below the resonance frequency Fr.

If instead the frequency range spanned by the sequence of actuation frequency values TFa(j) has been recognised to include the resonance frequency Fr because the control unit 160 has assessed that one or more of the actuation frequency values TFa(j) of the sequence are lower than the resonance frequency Fr, such frequency range cannot be considered as a safe range as a whole. Therefore, the control unit 160 cannot freely set the actuation frequency Fa to any value comprised in said actuation frequency range, because at least a portion of such actuation frequency range comprises frequencies which are lower than the resonance frequency Fr. In this case, according to an embodiment of the present invention, the control unit 160 may select a safe actuation frequency subrange from the spanned frequency range based on the closeness of the actuation frequency values TFa(j) of the sequence to the resonance frequency Fr, such as for example by setting a lower boundary for such subrange equal to or higher than the actuation frequency value TFa(j) which has been assessed to be the closest one to the resonance frequency Fr.

Figure 4A:
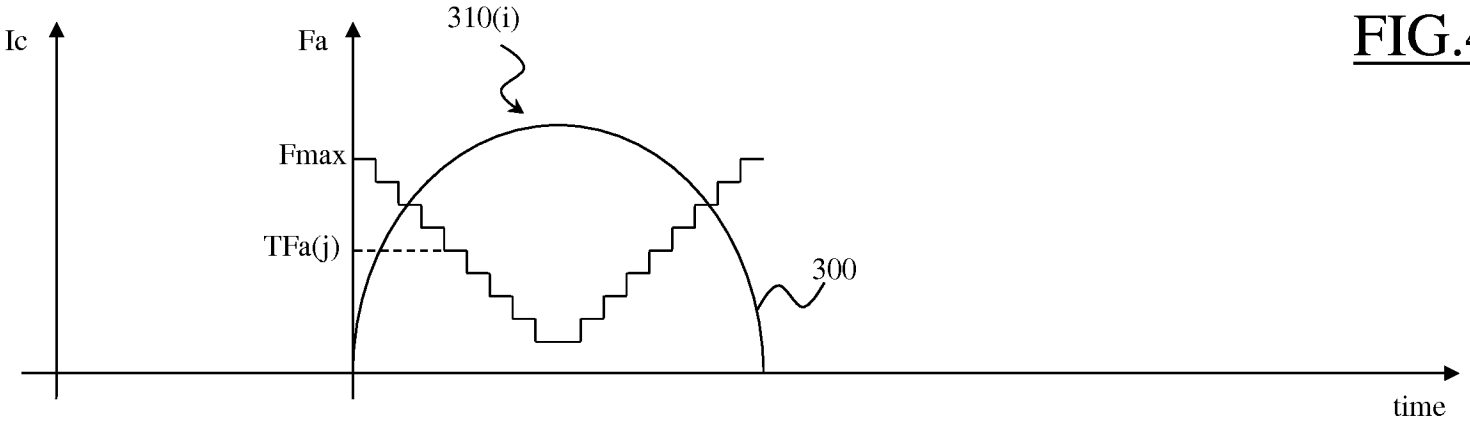
FIGS. 4A and 4B illustrate the evolution in time of the actuation frequency of control signals of the inverter circuit of FIG. 2A during a resonance frequency procedure according to embodiments of the invention following two exemplary different predefined sequences of actuation frequency values.
Figure 4B:
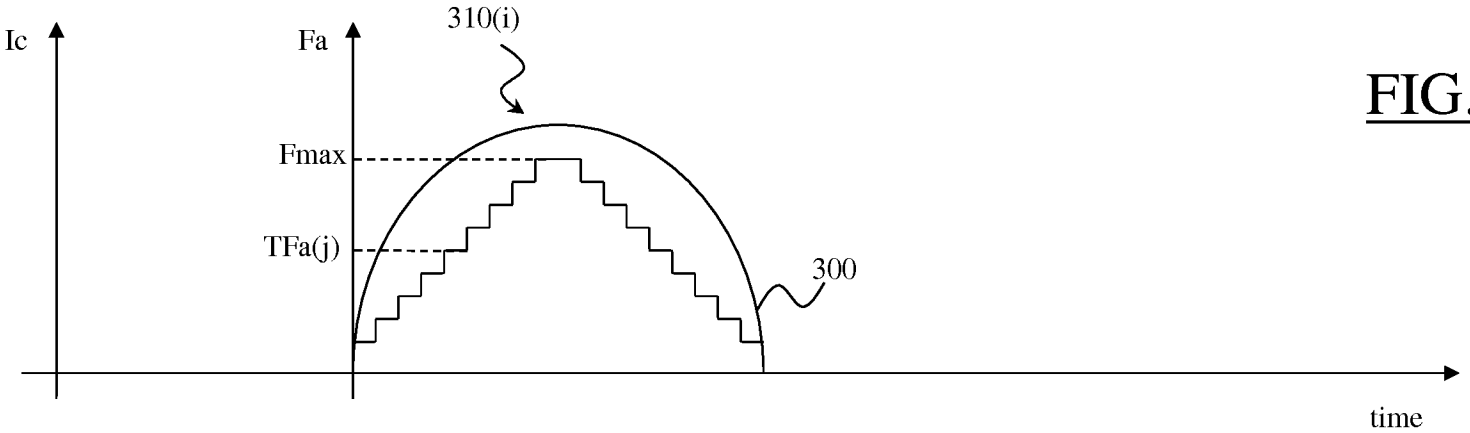

FIGS. 4A and 4B illustrate the evolution in time of the actuation frequency Fa of the control signals A1, A2 set by the control unit 160 during the procedure according to embodiments of the invention following two exemplary different predefined sequences of actuation frequency values TFa(j).

In the example illustrated in FIG. 4A, the predefined sequence of actuation frequency values TFa(j) provides for starting from a first actuation frequency value TFa(1), then proceeding with lower and lower actuation frequency values TFa(j) every time interval tj equal to a fraction of the semiperiod of the input AC voltage Vin (and therefore equal to a fraction of the duration of the half wave 310(*i*) of the envelope 300), until substantially reaching the centre of the half wave 310(*i*); then, the predefined sequence of actuation frequency values TFa(j) provides for proceeding with higher and higher actuation frequency values TFa(j) every time interval tj until reaching the end of the half wave 310(*i*). For example, tj may be equal to 0.3 msec. In this way, as visible in FIG. 4A, the evolution in time of the actuation frequency Fa comprises a decreasing ramp followed by an increasing ramp.

According to an embodiment of the present invention, the first actuation frequency value TFa(1) of the sequence is advantageously set to the maximum switching frequency Fmax of the IGBTs. However, similar considerations apply in case a different (e.g., lower) frequency value is used as the first actuation frequency value TFa(1) of the sequence.

According to an embodiment of the present invention, an estimation of the resonance frequency Fr can be calculated by taking into account the actuation frequency value TFa(j) which is the closest one to the resonance frequency Fr itself.

According to an embodiment of the present invention, the sequence of actuation frequency values TFa(j) is such that the lower boundary of the frequency range spanned by the sequence of actuation frequency values TFa(j)—i.e., the actuation frequency value TFa(j) corresponding to the end of the decreasing ramp—is set to a sufficiently low value to include the resonance frequency Fr. Moreover, according to an embodiment of the present invention, a safe actuation frequency range may be set having as a lower boundary the actuation frequency value TFa(j) which has been assessed to be the closest one to the resonance frequency Fr. According to another embodiment of the present invention, a safe actuation frequency range may be set having as a lower boundary a frequency value higher than the actuation frequency value TFa(j) which has been assessed to be the closest one to the resonance frequency Fr.

According to another embodiment of the present invention, the sequence of actuation frequency values TFa(j) is such that the lower boundary of the frequency range spanned by the sequence of actuation frequency values TFa(j)—i.e., the actuation frequency value TFa(j) corresponding to the end of the decreasing ramp—is set to a sufficiently high value in order to be higher than the resonance frequency Fr. In this case, the frequency range spanned by the sequence of actuation frequency values TFa(j) can be assumed to be a safe actuation frequency range, i.e., the actuation frequency Fa can be freely set to any value comprised in said actuation frequency range without incurring in the risk of reaching and going below the resonance frequency Fr.

In the example illustrated in FIG. 4B, the predefined sequence of actuation frequency values TFa(j) provides for starting from a first actuation frequency value TFa(1), then proceeding with higher and higher actuation frequency values TFa(j) every time interval tj equal to a fraction of the semiperiod of the input AC voltage Vin (and therefore equal to a fraction of the duration of the half wave 310(*i*) of the envelope 300), until substantially reaching the centre of the half wave 310(*i*); then, the predefined sequence of actuation frequency values TFa(j) provides for proceeding with lower and lower actuation frequency values TFa(j) every time interval tj until reaching the end of the half wave 310(*i*). In this way, as visible in FIG. 4B, the evolution in time of the actuation frequency Fa comprises an increasing ramp followed by a decreasing ramp. According to an embodiment of the present invention, the higher actuation frequency value TFa(j) of the sequence (i.e., the one corresponding to substantially the centre of the half wave 310(*i*)) is advantageously set to the maximum switching frequency Fmax of the IGBTs.

The symmetry of the predefined sequence of actuation frequency values TFa(j) illustrated in FIG. 4A (i.e., with a decreasing ramp followed by an increasing ramp) and in FIG. 4B (i.e., with an increasing ramp followed by a decreasing ramp) allows to advantageously carry out a double measurement, improving the reliability of the result. However similar considerations apply in case such symmetry is not present, such as for example with a single decreasing ramp or a single increasing ramp. Moreover, the concepts of the present invention can be applied as well to different types of predefined sequences of actuation frequency values TFa(j), having any profile, provided that the actuation frequency Fa is varied within the half wave 310(*i*) of the envelope 300.

According to another embodiment of the present invention, as soon as the control unit 160 assesses that an actuation frequency value TFa(j) results to be very close to the resonance frequency Fr (e.g., when the distance between the zero crossing time of the induction heating coil voltage and the zero crossing time of the induction heating coil current Ic is lower than a safe threshold), the actuation frequency Fa is clamped to said actuation frequency value TFa(j) (or also to a higher value) for the rest of the halfwave 310(*i*), or for more than one subsequent halfwaves for allowing a fast high power delivery, or even for the rest of the halfwave in which the user has requested a power corresponding to a lower actuation frequency.

Figure 4C:
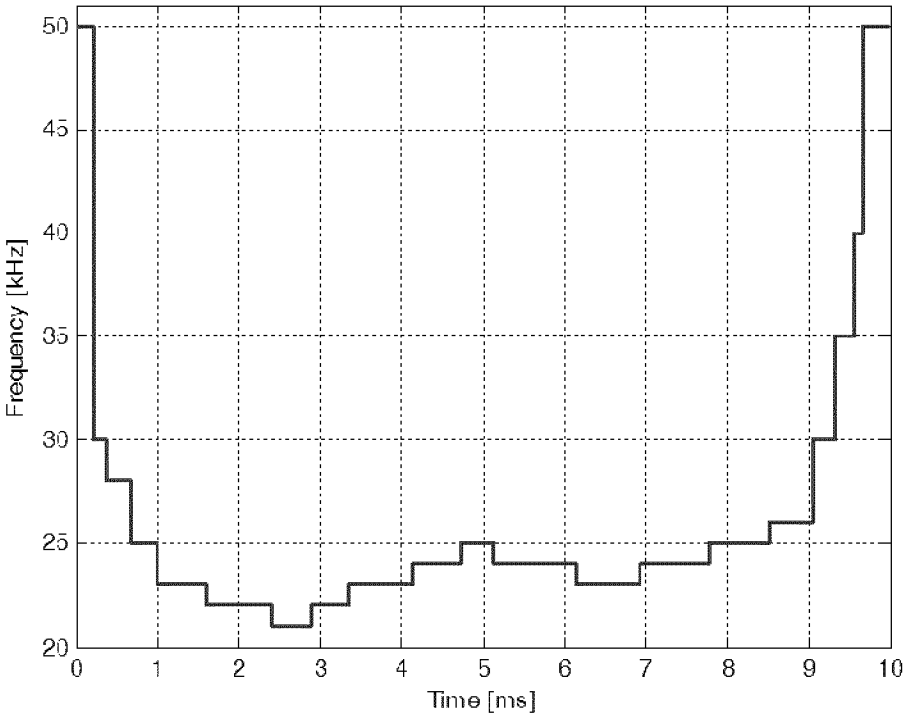
FIG. 4C illustrates the evolution in time of the actuation frequency of control signals of the inverter circuit of FIG. 2A during a resonance frequency procedure according to an embodiment of the invention following an exemplary dynamically calculated sequence of actuation frequency values.

According to another embodiment of the present invention, instead of having a predefined sequence of actuation frequency values TFa(j), each new actuation frequency value TFa(j) in the sequence is dynamically calculated by the control unit 160 based, for instance, on the distance of the previous actuation frequency value TFa(j) in the sequence with respect to the actual resonance frequency Fr (wherein said distance may be evaluated according to one of the previously mentioned methods). In this way, it is possible to refine the resonance frequency Fr search when in the proximity of the resonance frequency Fr itself. An example of a sequence of actuation frequency values TFa(j) calculated in a dynamic way is illustrated in FIG. 4C.

According to an embodiment of the present invention, the distance among the actuation frequency values TFa(j) of the sequence with respect to the actual resonance frequency Fr is evaluated by calculating the power factor cos φ corresponding to the induction coil 135 (the closer the power factor cos φ to 1, the closer the actuation frequency value TFa(j) to the resonance frequency Fr). The power factor cos φ may be calculated by comparing for each actuation frequency value TFa(j) the distance between the zero crossing time of the induction heating coil voltage and the zero crossing time of the induction heating coil current Ic related to the actuation period Ta=1/Fa.

Thanks to the proposed procedure, it is possible to assess the resonance frequency Fr and/or the safe actuation frequency range in a very short time (for an input AC voltage Vin oscillating at a mains frequency Fm of 50 Hz, the procedure for assessing the resonance frequency Fr lasts at most 10 ms), which is fully compatible with the fast changes of the coupling between the load and the induction heating coil typical of induction ironing. Therefore, compared with the known procedures, the proposed procedure is more efficient from the time execution speed and the power delivery points of view.

The previously described procedure for assessing the resonance frequency and/or the safe actuation frequency range may be repeated several times (either consecutively or not) to collect more resonance frequency assessments in order to improve the reliability of the result.

Safe Actuation Frequency Range Assessment Having Regard to the Current Limit Frequency As already mentioned above, the inverter circuit 140 may be provided with a clamping circuit (not illustrated) configured to clamp the induction heating coil current Ic when it reaches the maximum current that can be sustained by the IGBTs 212*h*, 212*l*. Additionally, or alternatively, a software protection may be provided, configured to clamp the actuation frequency Fa of the control signals A1, A2 before the induction heating coil current Ic reaches the maximum current that can be sustained by the IGBTs 212*h*, 212*l*.

According to an embodiment of the present invention, the procedure for assessing the safe actuation frequency range having regard to current limit frequency Fc is carried out by the control unit 160 by varying step by step the actuation frequency Fa of the control signals A1, A2 in the same way as for the procedure for assessing the safe actuation frequency range having regard to resonance frequency, i.e., according to a sequence of actuation frequency values TFa(j) within a same half wave 310(*i*) of the envelope 300 of the current Ic, until a condition of maximum allowable current is approached, requiring to clamp the actuation frequency Fa to an actuation frequency value TFa(j) corresponding to an induction heating coil current Ic value close to the maximum current that can be sustained by the IGBTs 212*h*, 212*l*, or until a suitable range of actuation frequencies TFa(j) is explored. The considerations about the sequence of actuation frequency values TFa(j) carried out for the procedure for assessing the safe actuation frequency range having regard to the resonance frequency apply as well to the procedure for assessing the safe actuation frequency range having regard to the current limit frequency.

According to an embodiment of the present invention, the control unit 160 measures at each j-th step of the sequence:

- a corresponding positive peak Ipp(j) of the induction heating coil current Ic, i.e., the highest positive value assumed by the induction heating coil current Ic oscillating at the frequency Fa=TFa(j) during the time interval tj, and
- a corresponding negative peak Inp(j) of the induction heating coil current Ic, i.e., the lowest negative value assumed by the induction heating coil current Ic oscillating at the frequency Fa=TFa(j) during the time interval tj.

Figure 5:
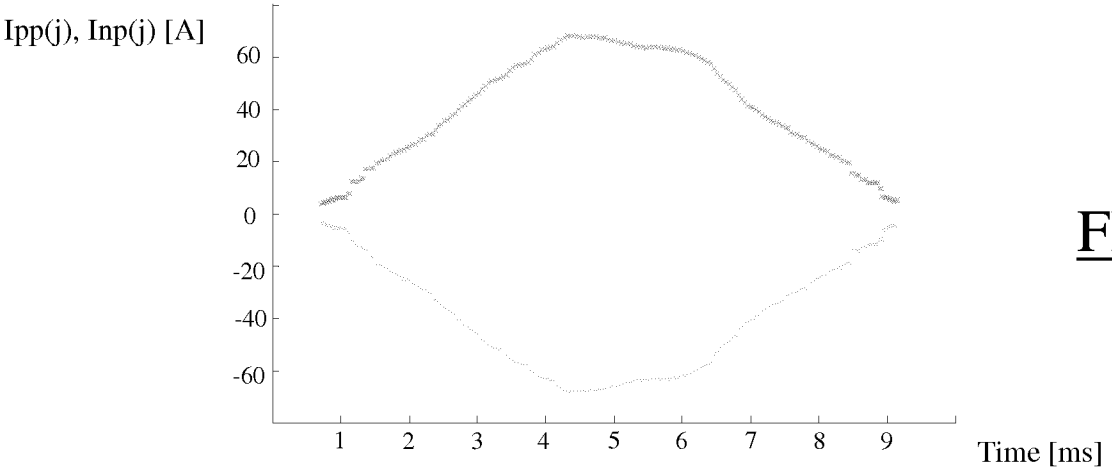
FIG. 5 illustrates measured positive peaks and negative peaks of the induction heating coil current versus time during an actuation frequency step by step variation according to an embodiment of the present invention.
Figure 6:
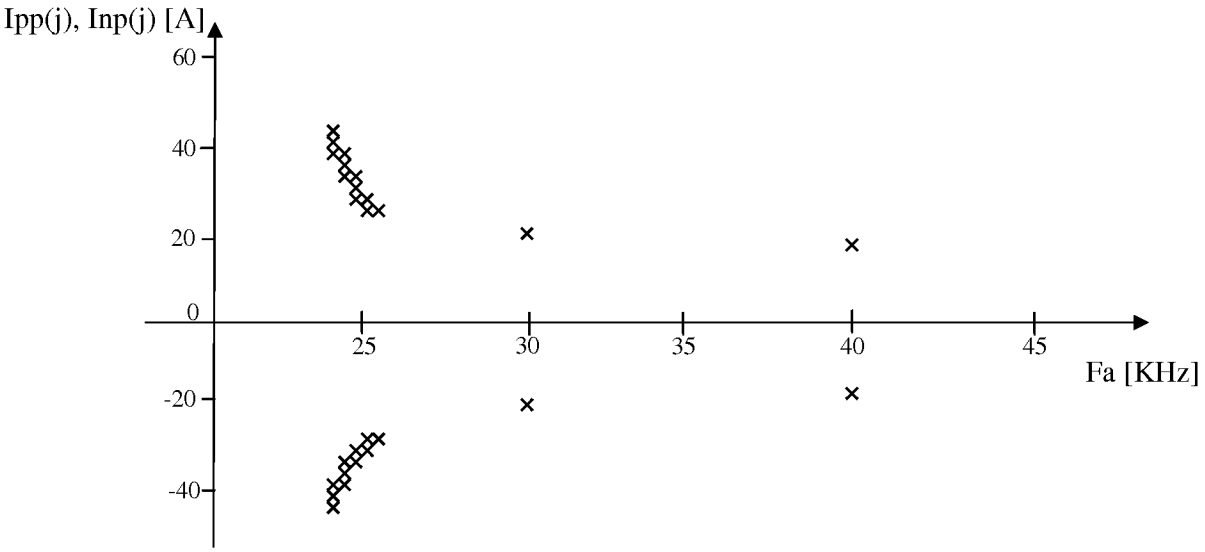
FIG. 6 illustrates the same positive and negative peaks of FIG. 5 versus the actuation frequency.

FIG. 5 illustrates, as a result of a test performed by the Applicant, a current peak/time relation CTR of the positive peaks Ipp(j) and the negative peaks Inp(j) measured by the control unit 160 with respect to time during an actuation frequency Fa step by step variation within an half wave 310(*i*) of the envelope 300, while FIG. 6 illustrates a current peak/actuation frequency relation CFR of the same positive and negative peaks Ipp(j), Inp(j) with respect to the actuation frequency Fa.

It has to be appreciated that the measures are carried out by varying the actuation frequency Fa within a same half wave 310(*i*) of the envelope 300, and the values of the positive and negative peaks Ipp(j), Inp(j) also depend on the position of the respective time interval tj with respect to the half wave 310(*i*) (for the same frequency, the more the time interval tj is close to the centre of the half wave 310(*i*), the higher the positive and negative peaks Ipp(j), Inp(j) (in absolute value)). Therefore, said measured values of the positive and negative peaks Ipp(j), Inp(j) are not indicative of the actual current peaks that could be measured using the actuation frequency value Fa=TFa(j) for the whole duration of the half wave 310(*i*). Indeed, if a current peak Ipp(j) measured at the begin or at the end of the half wave 310(*i*) was just barely lower than the maximum current that can be sustained by the IGBTs 212*h*, 212*l*, it is quite sure that if the corresponding actuation frequency value Fa=TFa(j) was used for the whole duration of the half wave 310(*i*), the induction heating coil current Ic would exceed the maximum current that can be sustained by the IGBTs 212*h*, 212*l* at the central portion of the half wave 310(*i*).

For this purpose, according to an embodiment of the present invention the control unit 160 is further configured to process (e.g., normalize) said measures so as to obtain corresponding compensated (e.g., normalised) positive and negative peaks NIpp(j), NInp(j) expressing an estimate of how such positive and negative peaks Ipp(j), Inp(j) would be if the measure was carried out during a time interval tj corresponding to the whole duration of the half wave 310(*i*) and therefore with a corresponding actuation frequency value Fa=TFa(j) set for the whole duration of the half wave 310(*i*).

According to an embodiment of the present invention, the normalised positive and negative peaks NIpp(j), NInp(j) are obtained by modifying each corresponding positive and negative peak Ipp(j), Inp(j) according to the position of the time interval tj of the measure with respect to the half wave 310(*i*). For example, according to an embodiment of the present invention, the normalised positive and negative peaks NIpp(j), NInp(j) are obtained by modifying each corresponding positive and negative peak Ipp(j), Inp(j) through (e.g., by multiplying them by) an expansion coefficient ec(j) whose value depends on the position of the time interval tj of the measure with respect to the half wave 310(*i*). For example, according to an embodiment of the present invention, the more the time interval tj is far from the centre of the half wave 310(*i*), the higher the expansion coefficient ec(j). According to an embodiment of the present invention, the position of the time interval tj with respect to the half wave 310(*i*) is determined by measuring the value of the input AC voltage Vin during the time interval tj.

Figure 7:
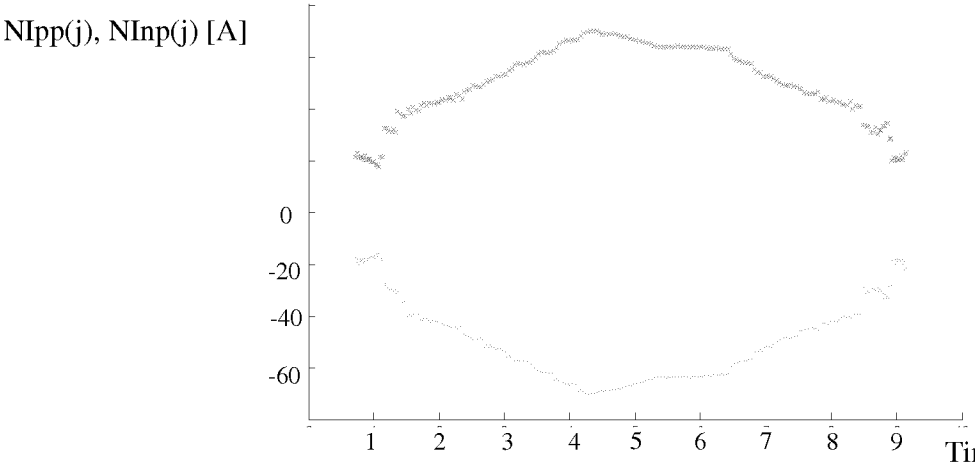
FIG. 7 illustrates normalised positive peaks and normalised negative peaks versus time obtained from the measured positive peaks and the negative peaks of FIG. 5.
Figure 8:
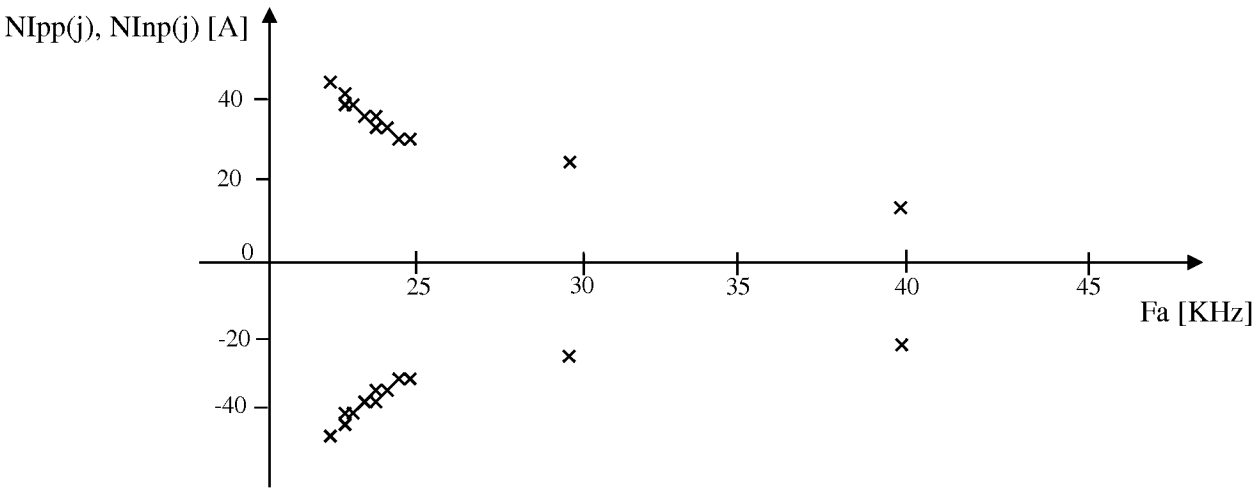
FIG. 8 illustrates the same normalised positive and negative peaks of FIG. 7 versus the actuation frequency.

FIG. 7 illustrates a normalised current peak/time relation NCTR of the normalised positive peaks NIpp(j) and the normalised negative peaks NInp(j) with respect to time obtained from the measured positive peaks Ipp(j) and the negative peaks Inp(j) of the current peak/time relation CTR of FIG. 5. FIG. 8 illustrates a normalised current peak/actuation frequency relation NCFR of the same normalised positive and negative peaks NIpp(j), NInp(j) with respect to the actuation frequency Fa.

Using the normalised positive and negative peaks NIpp(j), NInp(j), the control unit 160 is thus capable of assessing which is the maximum induction heating coil current Ic that flows through the IGBTs 212*h*, 212*l* for each one of the considered actuation frequency values Fa=TFa(j), in such a way to assess the current limit frequency Fc (i.e., the minimum actuation frequency Fa value for which the induction heating coil current Ic is lower than the maximum current that can be sustained by the IGBTs 212*h*, 212*l*). According to an embodiment of the present invention, the current limit frequency Fc is assessed by comparing for each one of the considered actuation frequency values Fa=TFa(j) the corresponding normalised positive and negative peaks NIpp(j), NInp(j) with the maximum current that can be sustained by the IGBTs 212*h*, 212*l*.

According to an embodiment of the present invention, an estimation of the current limit frequency Fc can be calculated by taking into account the actuation frequency value TFa(j) which is the one whose corresponding normalised positive or negative peak NIpp(j), NInp(j) is the closest one to the maximum current that can be sustained by the IGBTs 212*h*, 212*l*.

The concepts of the present invention can be applied as well by considering only the positive peaks or only the negative peaks of the induction heating coil current Ic.

Thanks to the proposed procedure, it is possible to assess the current limit frequency Fc and/or the safe actuation frequency range in a very short time (for an input AC voltage Vin oscillating at a mains frequency Fm of 50 Hz, the procedure lasts at most 10 msec), which is fully compatible with the fast changes of the coupling between the load and the induction heating coil typical of induction ironing. Therefore, compared with the known procedures, the proposed procedure is more efficient from the power delivery point of view due to the fact, for instance, that allow the control unit to deliver the maximum allowable power soon after the detection of limit detection. § § §

Power delivery in compliance with the assessed safe actuation frequency range

According to an embodiment of the present invention, both the procedure for assessing the safe actuation frequency range having regard to the resonance frequency and the procedure for assessing the safe actuation frequency range having regard to the current limit frequency can be concurrently carried out by the control unit 160 using the same sequence of actuation frequency values TFa(j).

According to an embodiment of the present invention, once a safe actuation frequency range has been determined based on the closeness of the actuation frequency values TFa(j) to t least one among the resonance frequency Fr and the current limit frequency Fc, the control unit 160 is configured to actually set the frequency of the AC current flowing in the induction coils 135 (i.e., the actuation frequency Fa) taking into consideration the assessed safe actuation frequency range, in such a way to regulate the delivered electric power according to the request of the user, avoiding at the same time any malfunctioning or damage in the devices.

According to an embodiment of the present invention, if the request of the user is not compatible with the assessed safe actuation frequency range, such exact request cannot be satisfied, and the control unit 160 is configured to set the actuation frequency (and therefore, the delivered electric power) to a safe level different from the requested one.

According to an embodiment of the present invention, once a safe actuation frequency range has been determined, the control unit 160 may be also configured to set the actuation frequency Fa to the value corresponding to the delivering of the highest possible amount of electric power among the values comprised in the safe actuation frequency range. § § §

The previously described procedures for determining a safe actuation range have been described by making reference to a single induction coil 135 at a time. However, there can be various application scenarios in which two or more induction coils 135 should be activated and controlled together for heating a same load. For example, in the ironing system 100 illustrated in FIG. 1A, the clothes iron 110 may be positioned in such a way that the plate 125 thereof is above two different induction coils 135. Making instead reference to the induction cooking system 100' illustrated in FIG. 1B, a composite cooking zone 190 corresponding to the sum of two or more single cooking zones 170 may be defined by concurrently activating and controlling two or more adjacent induction coils 135 to provide heat to a large cooking pan 180 positioned in such a way to be above the induction coils 135 forming such composite cooking zone 190.

In the following of the description there will be described how an induction heating system such as the ironing system 100 or the induction cooking system 100' is operated to simultaneously control a group of two or more induction coils 135 according to an embodiment of the present invention.

According to an embodiment of the present invention, in order to jointly activate and control a group of induction coils 135(*k*) (k=1, 2, . . . ), the control unit 160 carries out the following operations.

Figure 9:
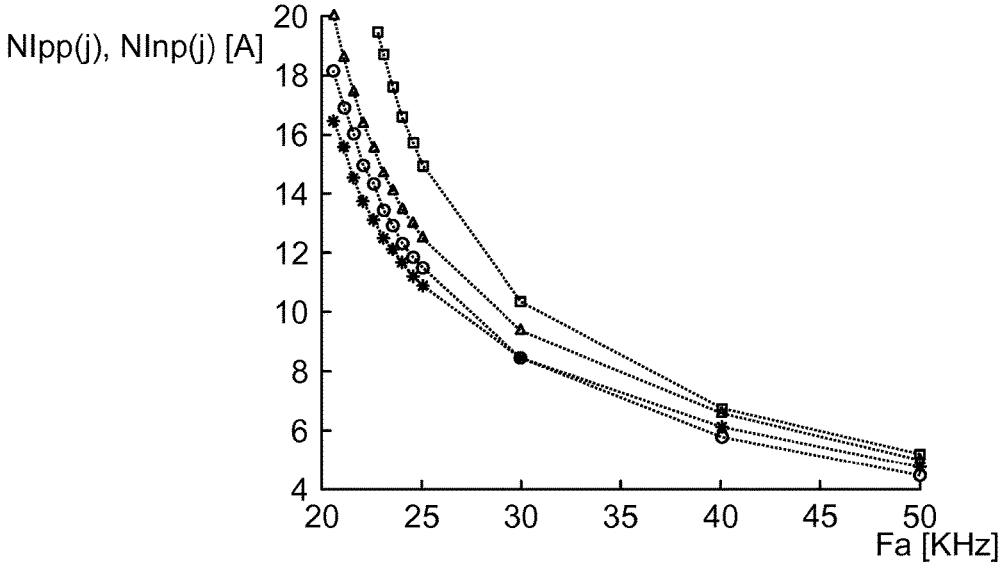
FIG. 9 illustrates four exemplary normalised current peak/actuation frequency relations each one obtained from measures carried out on a respective induction coil.

For each induction coil 135(*k*) of the group, the control unit 160 carries out the operations previously described for calculating a corresponding estimation of the resonance frequency Fr(k) thereof, and a corresponding estimation of the current limit frequency Fc(k) thereof. Moreover, for each induction coil 135(*k*) of the group, the control unit 160 carries out the operations previously described for obtaining a corresponding normalised current peak/actuation frequency relation NCFR(k). FIG. 9 illustrates four exemplary normalised current peak/actuation frequency relations NCFR(k) (k=1, 2, 3, 4) each one obtained from measures carried out on a respective induction coil 135(*k*) (k=1, 2, 3, 4) of the group.

Then, the control unit 160 sets a global resonance frequency Frg to the more restrictive—i.e., the highest—one among the resonance frequency Fr(k) estimations for the corresponding induction coils 135(*k*) of the group.

Similarly, the control unit 160 sets a global current limit frequency Fcg to the more restrictive—i.e., the highest—one among the current limit frequency Fc(k) estimations for the corresponding induction coils 135(*k*) of the group.

Figure 10:
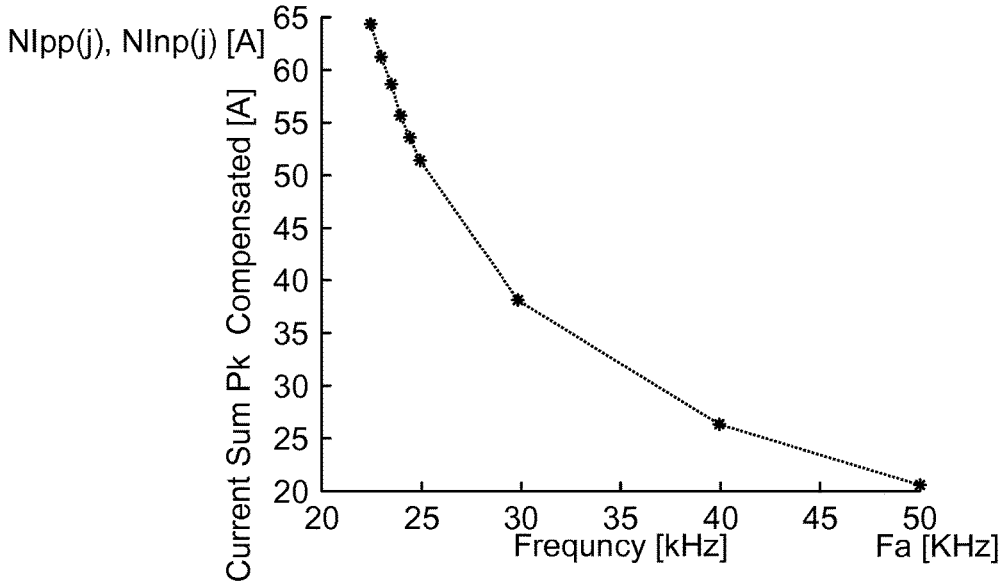
FIG. 10 illustrates a global normalised current peak/actuation frequency relation corresponding to the sum of the four normalised current peak/actuation frequency relations of FIG. 9.

The control unit 160 sums to each other the normalised current peak/actuation frequency relations NCFR(k) corresponding to the induction coils 135(*k*) of the group in order to obtain a corresponding global normalised current peak/actuation frequency relation NCFRg expressing the relation occurring between the sum of the normalised positive and negative peaks NIpp(j), NInp(j) of the various induction coils 135(*k*) of the group, and the actuation frequency Fa. An example of such global normalised current peak/actuation frequency relation NCFRg corresponding to the four exemplary normalised current peak/actuation frequency relations NCFR(k) (k=1, 2, 3, 4) of FIG. 9 is illustrated in FIG. 10.

At this point, having calculated the global resonance frequency Frg, the global current limit frequency Fcg, the control unit 160 globally controls the induction coils 135(*k*) of the group with a same actuation frequency Fa as if said induction coils 135(*k*) were a single induction coil 135(*k*) by setting the actuation frequency Fa in a safe actuation frequency range that ensure compliance with the global resonance frequency Frg and/or the global current limit frequency Fcg, as previously described when a single induction coil 135 only was considered.

Thanks to this solution, a plurality of induction coils may be easily turned on in a very short time.

According to an embodiment of the present invention, the operations pertaining to the calculation of the resonance frequency Fr(k), the current limit frequency Fc(k), and the normalised current peak/actuation frequency relation NCFR(k) are carried out by the control unit 160 concurrently for all induction coils 135(*k*) of the group (in a same half-wave 310(*i*) of the envelope 300). The same sequence of actuation frequency values TFa(j) is employed for all the induction coils 135(*k*) of the group, or alternatively each induction coil 135(*k*) of the group may be driven by exploiting a respective sequence of actuation frequency values TFa(j), which is generally different than the ones employed for the other induction coils 135(*k*) of the group.

According to another embodiment of the invention, the operations pertaining to the calculation of the resonance frequency Fr(k), the current limit frequency Fc(k), and the normalised current peak/actuation frequency relation NCFR(k) are sequentially carried out by the control unit 160 for each induction coil 135(*k*) of the group (in sequential half-waves 310(*i*) of the envelope 300). The same sequence of actuation frequency values TFa(j) is employed for all the induction coils 135(*k*) of the group. Alternatively each induction coil 135(*k*) of the group is driven by exploiting a respective sequence of actuation frequency values TFa(j), which is generally different than the ones employed for the other induction coils 135(*k*) of the group. In this latter case, a pre-processing action should be carried out in order to obtain a representation using the same frequency base for all the induction coils 135(*k*) of the group. Moreover, carrying out such operations sequentially, implies some measure discrepancy due to the fact that the magnetic interaction among induction coils 135(*k*) of the group is lost if the induction coils 135(*k*) of the group are singularly activated in a sequence.

Mixed solutions are also contemplated, in which operations pertaining to induction coils 135(*k*) of at least one subgroup of the whole group are carried out concurrently.

It has to be appreciated that in order to concurrently carry out the operations for calculating the resonance frequency Fr(k), the current limit frequency Fc(k), and the normalised current peak/actuation frequency relation NCFR(k), on two or more induction coils 135(*k*) the corresponding request of current should be lower than the maximum allowable current that the respective DClink (not illustrated) of the induction (ironing or cooking) system is capable to provide. For this reason, according to an embodiment of the present invention, all the induction coils 135(*k*) affecting a same DClink should be monitored to stop any request of increasing current if the total requested current is higher than the maximum allowable current provided by the respective DClink. According to an embodiment of the present invention, a way to limit the absorbed current is limiting the frequency decrease.

According to an embodiment of the present invention, if the dynamic of an induction coil 135(*k*) of the group is so small to limit the global performance of the group of induction coils 135(*k*), such induction coil 135(*k*) may be excluded from the activation to increase the power delivered to the other induction coils 135(*k*) of the group.

According to an embodiment of the present invention, the same procedure described above may be in principle used to select different actuation frequencies Fa to be singularly used to the various induction coils 135(*k*) of the group. In this case, beating noise can be generated caused by the interaction between induction coils 135(*k*) working at different frequencies. The beating noise may be avoided if the actuation frequencies Fa used for the various induction coils 135(*k*) are properly spaced to each other.

Although for describing the procedures according to the embodiments of the present invention reference has been made to an induction ironing system and to an induction cooking system, the concepts of the present invention can be applied as well to any induction heating system, such as an induction water heating system, wherein the induction heating coil(s) may be installed in a water heater for generating a time-varying magnetic field in order to heat a water tank.

Naturally, in order to satisfy local and specific requirements, a person skilled in the art may apply to the solution described above many logical and/or physical modifications and alterations.

The invention claimed is:

1. A method for managing an induction heating system, the induction heating system comprising:

an electrically conducting load;

an inverter circuit comprising a switching section and a resonant section, the switching section comprising switching devices adapted to generate an AC current from an AC input voltage comprising a plurality of half-waves, and the resonant section comprising an induction heating coil adapted to receive the AC current for generating a corresponding time-varying magnetic field in order to generate heat in the electrically conducting load by inductive coupling, wherein the AC current oscillates at an actuation frequency of the switching devices and has an envelope comprising a plurality of half-waves corresponding to the half-waves of the AC input voltage, and wherein the amount of heat generated in the load depends on the frequency of the AC current, the method comprising:

varying, within a same half-wave of the envelope, the actuation frequency according to a plurality of actuation frequency values;

determining a safe actuation frequency range;

setting the actuation frequency based on said determined safe actuation frequency range, wherein said determining a safe actuation frequency range comprises calculating at least one between:

the closeness of each actuation frequency value to a resonance frequency of the resonant section, the closeness of each actuation frequency value to a current limit frequency corresponding to the maximum sustainable current by the switching devices.

2. The method of claim 1, wherein said step of calculating the closeness of each actuation frequency value to a resonance frequency of the resonant section comprises measuring the distance between the zero crossing time of the voltage across the induction heating coil and the zero crossing time of the AC current.

3. The method of claim 1, wherein said step of calculating the closeness of each actuation frequency value to a resonance frequency of the resonant section comprises calculating a power factor corresponding to the induction heating coil.

4. The method of claim 1, wherein said step of varying, within a same half-wave of the envelope, the actuation frequency comprises setting step by step the actuation frequency according to a sequence of actuation frequency values, each actuation frequency value of the sequence being set for a corresponding time interval corresponding to a fraction of the duration of the half-wave of the envelope.

5. The method of claim 4, wherein said step of calculating the closeness of each actuation frequency value to a current limit frequency corresponding to the maximum sustainable current by the switching devices comprises:

for each actuation frequency value of the sequence, calculating a current positive peak corresponding to the highest positive value assumed by the AC current during the corresponding time interval, and/or calculating a current negative peak corresponding to the lowest positive value assumed by the AC current during the corresponding time interval;

calculating the closeness of each actuation frequency value to said current limit frequency based on said current positive peaks and/or current negative peaks.

6. The method of claim 5, further comprising normalizing each current positive peak and/or current negative peak according to the position of the corresponding time interval with respect to said half-wave, said calculating the closeness of each actuation frequency value to said current limit frequency based on said current positive peaks and/or current negative peaks further comprising calculating the closeness of each actuation frequency value to said current limit frequency based on said normalized current positive peaks and/or said normalized current negative peaks.

7. The method of claim 4 wherein said sequence of actuation frequency values comprises a first sequence portion starting from a first actuation frequency value and then proceeding with lower actuation frequency values at every time interval corresponding to a fraction of the duration of the half-wave of the envelope.

8. The method of claim 7, wherein said sequence of actuation frequency values comprises a second sequence portion starting from the last actuation frequency value of the first sequence portion and then proceeding with higher actuation frequency values at every time interval corresponding to a fraction of the duration of the half-wave of the envelope.

9. The method of claim 4, wherein said sequence of actuation frequency values comprises a first sequence portion starting from a first actuation frequency value and then proceeding with higher actuation frequency values at every time interval corresponding to a fraction of the duration of the half-wave of the envelope.

10. The method of claim 9, wherein said sequence of actuation frequency values comprises a second sequence portion starting from the last actuation frequency value of the first sequence portion and then proceeding with lower actuation frequency values at every time interval corresponding to a fraction of the duration of the half-wave of the envelope.

11. The method of claim 4, wherein said step of varying, within a same half-wave of the envelope, the actuation frequency comprises setting each new actuation frequency value of the sequence except the first one based on the distance of the previous actuation frequency value in the sequence with respect to the actual resonance frequency.

12. The method of claim 1, wherein said step of varying, within a same half-wave of the envelope, the actuation frequency comprises spanning a corresponding actuation frequency range, the method further including:

conditioned to the assessment that the values of said spanned actuation frequency range are higher than the resonance frequency and the current limit frequency, selecting said safe actuation frequency range as said spanned actuation frequency range.

13. The method of claim 12, further comprising:

conditioned to the assessment that at least one among the resonance frequency and the current limit frequency is higher than at least one value of said spanned actuation frequency, selecting said safe actuation frequency range from a subrange of said spanned actuation frequency, the values of said selected subrange being all higher than said resonance frequency and said current limit frequency.

14. The method of claim 1, further comprising, as soon as the closeness of an actuation frequency value to a resonance frequency of the resonant section is ascertained to be lower than a predefined threshold, limiting the actuation frequency to a value corresponding to said actuation frequency value.

15. The method of claim 1, wherein said method further comprises calculating an estimation of at least one among the resonance frequency and the current limit frequency.

16. The method of claim 15, wherein said method further comprises calculating an estimation of the resonance frequency by taking into account the actuation frequency value which is the closest one, among the plurality of actuation frequency values, to the resonance frequency itself.

17. The method of claim 15, wherein said method further comprises calculating an estimation of the current limit frequency by taking into account the actuation frequency value which is the closest one, among the plurality of actuation frequency values, to the current limit frequency itself.

18. The method of claim 15, wherein the induction heating system comprises a group of at least two induction heating coils, the method comprising:

for each induction heating coil of the group, calculating an estimation of the resonance frequency and an estimation of the current limit frequency corresponding to such induction heating coil;

setting a global resonance frequency based on the calculated estimations of the resonance frequency corresponding to the induction heating coils of the group;

setting a global current limit frequency based on the calculated estimations of the current limit frequency corresponding to the induction heating coils of the group;

determining the safe actuation frequency range according to said global resonance frequency and to said global current limit frequency.

19. The method of claim 18, wherein:

said setting the global resonance frequency comprises setting the global resonance frequency to the highest one among the calculated estimations of the resonance frequency corresponding to the induction heating coils of the group, and said setting the global current limit frequency comprises setting the global current limit frequency to the highest one among the calculated estimations of the current limit frequency corresponding to the induction heating coils of the group.

20. The method of claim 18, wherein said calculating an estimation of the resonance frequency and an estimation of the current limit frequency for each induction heating coil of the group is concurrently carried out for all the induction coils of the group in a same half-wave of the envelope.

21. The method of claim 18, wherein said calculating an estimation of the resonance frequency and an estimation of the current limit frequency for each induction heating coil of the group is sequentially carried out for all the induction coils of the group in sequential half-waves of the envelope.

22. The method of claim 18, wherein said calculating an estimation of the resonance frequency and an estimation of the current limit frequency for each induction heating coil of the group comprises varying the actuation frequency for each induction heating coil of the group according to a same sequence of actuation frequency values.

23. The method of claim 18, wherein said calculating an estimation of the resonance frequency and an estimation of the current limit frequency for each induction heating coil of the group comprises varying the actuation frequency for each induction heating coil of the group according to a respective sequence of actuation frequency values.

24. An induction heating system for heating an electrically conducting load, the induction heating system comprising:

an inverter circuit comprising a switching section and a resonant section, the switching section comprising switching devices adapted to generate an AC current from an AC input voltage comprising a plurality of half-waves, and the resonant section comprising an induction heating coil adapted to receive the AC current for generating a corresponding time-varying magnetic field in order to generate heat in the electrically conducting load by inductive coupling, wherein the AC current oscillates at an actuation frequency of the switching devices and has an envelope comprising a plurality of half-waves corresponding to the half-waves of the AC input voltage and wherein the amount of heat generated in the load depends on the frequency of the AC current, a control unit configured to:

vary, within a same half-wave of the envelope, the actuation frequency according to a plurality of actuation frequency values;

determine a safe actuation frequency range;

set the actuation frequency based on said determined safe actuation frequency range, wherein:

the control unit is configured to determine the safe actuation frequency range by calculating at least one between:

the closeness of each actuation frequency value to a resonance frequency of the resonant section, the closeness of each actuation frequency value to a current limit frequency corresponding to the maximum sustainable current by the switching devices.

25. The induction heating system of claim 24, wherein said inverter circuit is a selected one among:

a half-bridge inverter circuit;

a full-bridge inverter circuit, and a quasi-resonant inverter circuit.

26. The induction heating system of claim 24, wherein:

said electrically conducting load is a plate of a clothes iron and said induction heating coil is mounted on an ironing board, or said electrically conducting load is a portion of a cooking pan, and said induction heating coil is mounted in a cooking hob, or said electrically conducting load is a tank of a water heater, and said induction heating coil is mounted in a water heater.

* * * * *